US006015325A

United States Patent [19]

Inazuru et al.

[11] Patent Number: 6,015,325

[45] Date of Patent: Jan. 18, 2000

[54] METHOD FOR MANUFACTURING TRANSMISSION TYPE X-RAY TUBE

[75] Inventors: Tsutomu Inazuru; Kenji Suzuki, both of Hamamatsu, Japan

[73] Assignee: Hamamatsu Photonics K.K., Shizuoka, Japan

[21] Appl. No.: 09/113,372

[22] Filed: Jul. 10, 1998

[51] Int. Cl.[7] ..... H01J 9/00

[52] U.S. Cl. ..... 445/28; 445/43; 228/187

[58] Field of Search ..... 445/28, 29, 43; 228/187

[56] References Cited

U.S. PATENT DOCUMENTS

| | | | |
|---|---|---|---|
| 2,751,514 | 4/1956 | Atlee | 228/187 |
| 4,872,606 | 10/1989 | Satoh et al. | 228/187 |

FOREIGN PATENT DOCUMENTS

| | | |
|---|---|---|
| 37-5501 | 6/1962 | Japan . |
| 48-52390 | 7/1973 | Japan . |
| 57-187848 | 11/1982 | Japan . |
| 10-106463 | 4/1998 | Japan . |

*Primary Examiner*—Nimeshkumar D. Patel
*Assistant Examiner*—Todd Reed Hopper
*Attorney, Agent, or Firm*—Oliff & Berridge, PLC

[57] ABSTRACT

A method for manufacturing an X-ray tube that simplifies the manufacturing process, which method includes a stem unit assembly process, a high-temperature brazing process, an X-ray tube assembly process, and a low-temperature brazing process. In the stem unit assembly process, cathode pins are inserted through high-temperature brazing material and the cathode pin holes provided on the bottom plate member of the stem unit. In the high-temperature brazing process, the stem unit assembled in the above-described process is heated to the brazing temperature of the high-temperature brazing material used in the stem unit. In the X-ray tube assembly process, the focusing electrode, ceramic bulb, and output window are placed over the stem unit with low-temperature brazing material interposed between each component. In the low-temperature brazing process. the X-ray tube assembled in the above-described process Is heated to the brazing temperature of the low-temperature brazing material used in the X-ray tube assembly.

5 Claims, 9 Drawing Sheets

METHOD FOR MANUFACTURING TRANSMISSION TYPE X-RAY TUBE

BACKGROUND OF THE INVENTION

1. Field of the Invention

The present invention relates to a method for manufacturing an X-ray tube.

2. Description of the Prior Art

In an X-ray tube, electrons emitted from a heating filament are accelerated by high voltage applied between a cathode and anode within a tube in high vacuum and collide with an anode target surface opposing the cathode, generating X-rays. X-ray tubes include such medical uses as CT scanning and such industrial uses as nondestructive inspections and thickness measurements.

Conventionally, X-ray tubes have been manufactured by brazing cathode pins and an exhaust bulb to the bottom plate of the stem, where the cathode pins are used to supply electric current to the electron emitting coil and the exhaust bulb is used to exhaust gas from the bulb. Then, the focusing electrode, bulb, and output window containing the target are brazed to the stem by interposing brazing material between the components, fixing the components together with jigs, and heating the entire assembly to the brazing temperature of the brazing material.

However, with this manufacturing method, all the components that form the X-ray tube must be fixed with jigs to perform the brazing process. Therefore, it not only is difficult to fix each of the components simultaneously, but also is difficult to maintain the positions of each component accurately.

SUMMARY OF THE INVENTION

It is an object of the present invention to provide a method for manufacturing an X-ray tube which method is capable of simplifying the manufacturing process.

The method for manufacturing an X-ray tube of the present invention includes a stem unit assembly process, a high-temperature brazing process, an X-ray tube assembly process, and a low-temperature brazing process. In the stem unit assembly process, cathode pins are inserted through high-temperature brazing material and the cathode pin holes provided on the bottom plate member of the stem unit. In the high-temperature brazing process, the stem unit assembled in the above-described process is heated to the brazing temperature of the high-temperature brazing material used in the stem unit. In the X-ray tube assembly process, the focusing electrode, ceramic bulb, and output window are placed over the stem unit with low-temperature brazing material interposed between each component. In the low-temperature brazing process, the X-ray tube assembled in the above-described process is heated to the brazing temperature of the low-temperature brazing material used in the X-ray tube assembly.

Hence, the stem unit is manufactured first in the stem unit assembly and high-temperature brazing processes, and the X-ray tube is completed in the X-ray tube assembly and low-temperature brazing processes, simplifying the process. In other words, since the low-temperature brazing material is heated to a lower temperature than the brazing temperature of the high-temperature brazing material used in the stem unit assembly process, the high-temperature brazing material will not be melted when performing the low-temperature brazing process. Therefore, the cathode pins and the exhaust bulb will not slip from the positions that were set during the stem assembly and fixed during the high-temperature brazing process.

Silver brazing material can be used for the high-temperature brazing material, and brazing material composed of silver, copper, and titanium can be used for the low-temperature brazing material.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

Figure 1:
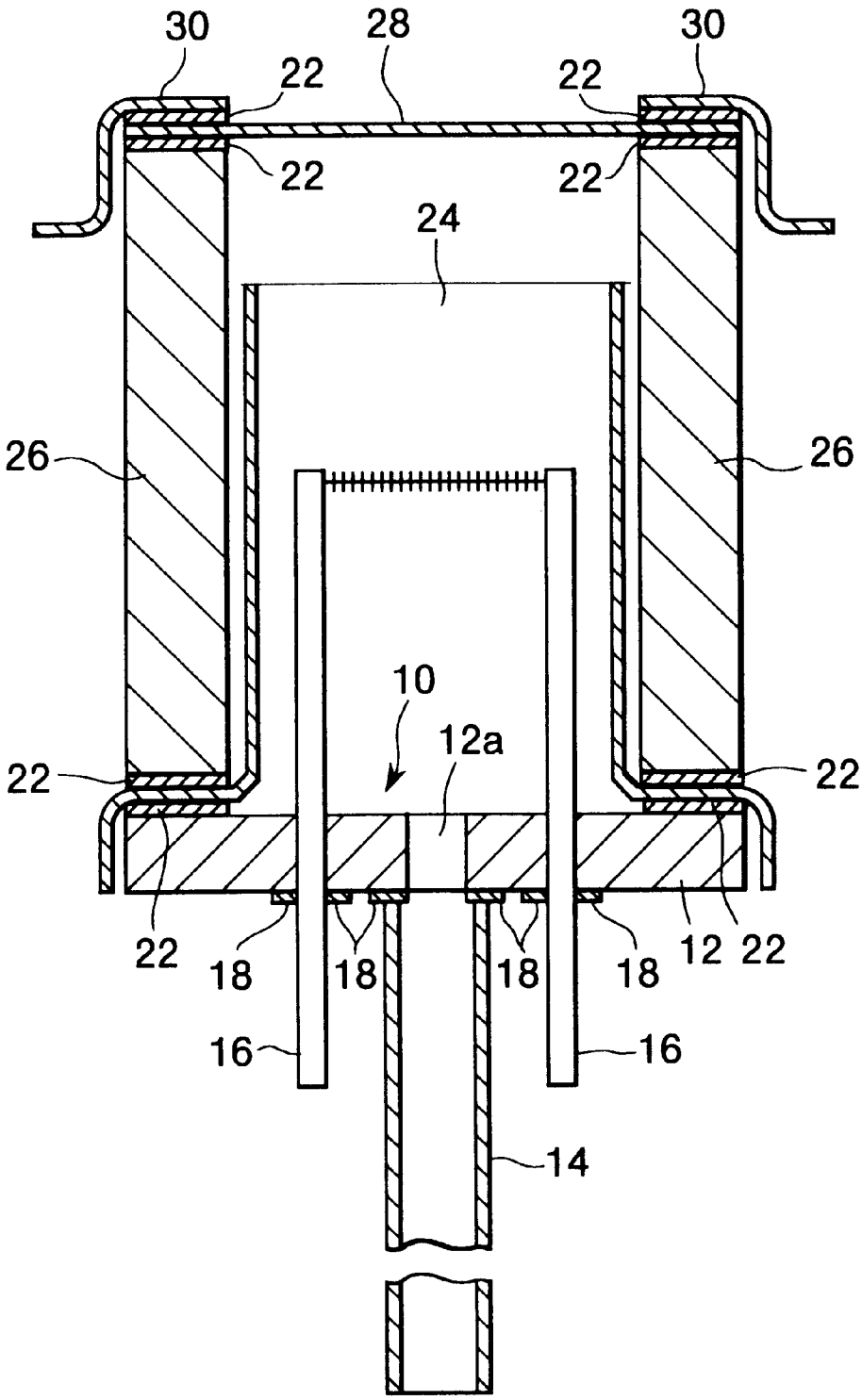
FIG. 1 is a vertical cross-sectional view of a transmission type X-ray tube according to a preferred embodiment of the present invention.

A transmission type X-ray tube according to a preferred embodiment of the present invention will be described while referring to the accompanying drawings.

First, the manufacturing process of the transmission type X-ray tube of FIG. 1 will be described with reference to FIGS. 2(*a*), 2(*b*) and 3. A stem unit 10 includes a disk-shaped bottom plate 12. This bottom plate 12 is manufactured by sintering aluminum powder and is formed with an exhaust bulb opening 12*a* through the center and two cathode pin openings 12*b*, one on either side of the exhaust bulb opening 12*a*, as shown in FIG. 2(*a*). An exhaust bulb 14 is joined with the exhaust bulb opening 12*a*. Also, cathode pins 16 are inserted through the cathode pin openings 12*b*. The cathode pins 16 are each formed with a flange portion 16*a*.

As shown in FIG. 2(*b*), one end of the exhaust bulb 14 is brazed to the exhaust bulb opening 12*a* of the bottom plate 12 with a high-temperature brazing material 18. The cathode pins 16 are inserted through the cathode pin openings 12*b* until the flange portions 16*a* contact the bottom plate member 12. The flange portions 16*a* are brazed to the bottom plate 12 using a high-temperature brazing material 18. In other words, high-temperature brazing material 18 is interposed between the bottom plate 12 and one end of the exhaust bulb 14 and between the bottom plate 12 and the flange portions 16*a* of the cathode pins 16 and held in place by jigs (stem unit assembly process). Then, brazing is performed by heating the entire assembly to the brazing temperature of the high-temperature brazing material 18 in a vacuum or a hydrogen atmosphere (a high-temperature brazing process). The assembly is later cooled to complete the manufacturing process of the stem unit 10.

The high-temperature brazing material 18 as used herein is silver solder (Ag 99.9%) having a brazing temperature of 961° C. Further, in order to perform reliable brazing, the brazing areas are metallized by coating copper (Cu), manganese (Mn), or the like, which has been melted by a binder, on the brazing areas around the exhaust bulb opening 12*a* and the cathode pin openings 12*b*.

Figure 3:
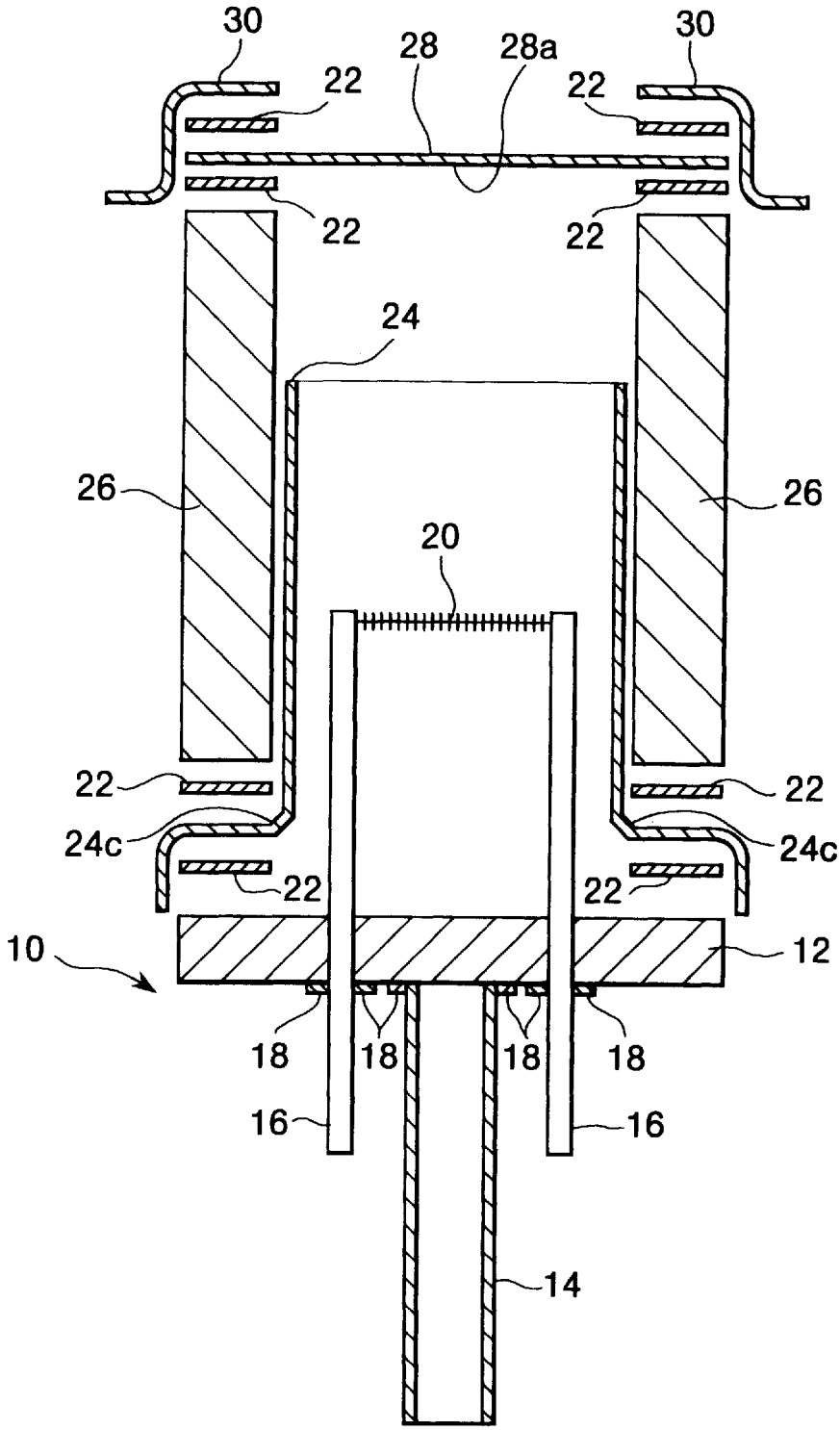
FIG. 3 is an explanatory diagram for the manufacturing process of the transmission type X-ray tube.

Next, each end of a tungsten coil 20 is welded to a tip of the cathode pins 16. Then, as shown in FIG. 3, the X-ray tube assembly is performed by mounting a focusing electrode 24, a ceramic bulb 26, an output window 28, and a conductive target voltage application cap 30 over the stem unit 10, in the order given (an X-ray tube assembly process).

Figure 4:
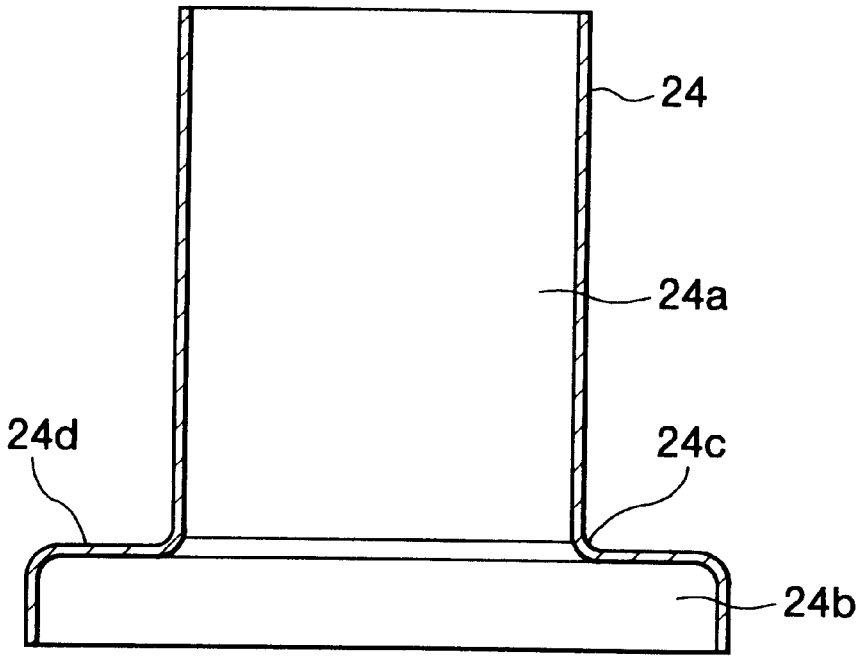
FIG. 4 is a cross-sectional view showing the vertical sections of the focusing electrode.

As shown in FIG. 4. the focusing electrode 24 is formed by pressing a Kovar metal plate, and polishing and defatting the surface of the plate. The focusing electrode 24 includes an upper cylindrical portion 24*a*; a lower cylindrical portion 24*b*; a slanted portion 24*c* provided around the circumference and between the upper cylindrical portion 24*a* and lower cylindrical portion 24*b*; and an overhang portion 24*d* extending outwardly from the slanted portion 24*c* and connecting to the lower cylindrical portion 24*b*. Here, the lower cylindrical portion 24*b* is formed with an inner diameter approximately the same as the outer diameter of the bottom plate 12. Therefore, when placing the focusing electrode 24 over the stem unit 10, the external periphery of the stem unit 10 contacts approximately the entire inner periphery of the lower cylindrical portion 24*b*.

The ceramic bulb 26 is formed by sintering aluminum powder into a cylindrical shape having an external diameter approximately equal to the external diameter of the bottom plate 12 and an internal diameter slightly larger than the external diameter of the upper cylindrical portion 24*a*. Hence, when the ceramic bulb 26 is placed over the focusing electrode 24, a gap is formed between the two. This gap is reliably formed according to the slanted portion 24*c*. In other words, when the ceramic bulb 26 is placed over the focusing electrode 24 so that the lower end of the ceramic bulb 26 is positioned over the slanted portion 24*c* of the focusing electrode 24, the lower end of the ceramic bulb 26 slips down over the slanted surface of the slanted portion 24*c* as far as the overhang portion 24*d*. By positioning the ceramic bulb 26 on the overhang portion 24*d* in this way, a gap is formed reliably between the outer surface of the upper cylindrical portion 24*a* and the inner surface of the ceramic bulb 26.

The output window 28 is formed by cutting a 0.2 mm thick amorphous carbon in a circular shape, after sand blastering the surface of the amorphous carbon. A back or inner surface 28*a* of the output window 28 is coated with a target metal, such as tungsten (W), titanium (Ti), or the like.

Figure 5:
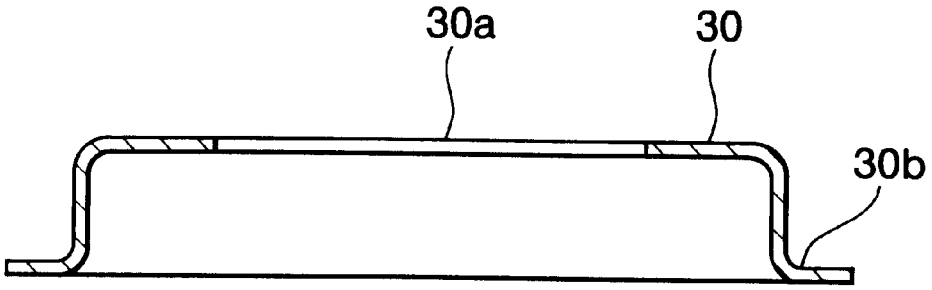
FIG. 5 is a cross-sectional view showing the vertical sections of the conductive target voltage application cap.

The conductive target voltage application cap 30 is formed by pressing a Kovar metal plate, and polishing and defatting the surface of the plate. As shown in FIG. 5, a circular window 30*a* is formed on the top portion of the conductive target voltage application cap 30 to expose the output window 28, while a flange portion 30*b* is provided on the lower portion. The conductive target voltage application cap 30 can protect the output window 28, preventing cracks and other damage from occurring in the output window 28, by positioning the conductive cap over the ceramic bulb 26 so as to cover the output window 28.

When assembling all the above described components, in order to braze various components together, a low temperature brazing material 22 is interposed between the top surface of the bottom plate 12 and the back surface of the overhang portion 24*d*; the front surface of the overhang portion 24*d* and the lower end of the ceramic bulb 26; the top end of the ceramic bulb 26 and the back surface of the output window 28; and the front surface of the output window 28 and the conductive target voltage cap 30.

The low temperature brazing material 22 as used herein is formed from silver (Ag 72%), copper (Cu 26%), and titanium (Ti 2%) and has a brazing temperature of between 780–800° C.

After all the above components have been assembled, the components are fixed together with jigs and placed in a vacuum brazing furnace. After the furnace is exhausted to the $1\times10^{-6}$ Torr level, the components are brazed at 800–850° C. for 10 minutes to complete the low-temperature brazing process.

Hence, since the low temperature brazing material 22 is brazed at a lower temperature than the high-temperature brazing material 18 used to manufacture the stem unit 10, the positions of the exhaust bulb 14 and cathode pins 16 determined in the stem 10 manufacturing process and brazed with the high-temperature brazing material 18 will not slip when performing the low temperature brazing.

Next, the vacuum brazing furnace is cooled to a temperature of 200° C., and the X-ray tube is removed from the furnace. Subsequently, the exhaust bulb 14 of the X-ray tube is connected to an exhaust device After the gas is evacuated from the X-ray tube, and the exhaust bulb 14 is hermetically sealed, the X-ray tube manufacturing process is complete.

Figure 2:
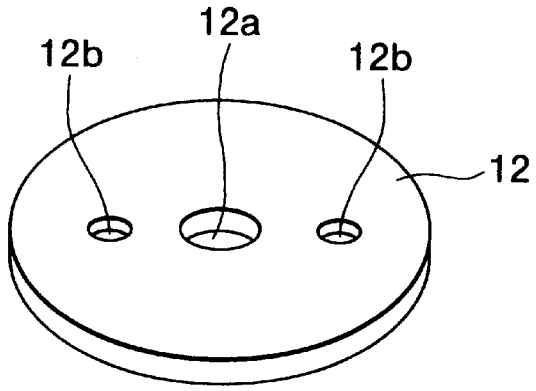
FIGS. 2*a* and 2*b* are explanatory diagrams for the manufacturing process of the transmission type X-ray tube.
Figure 2:
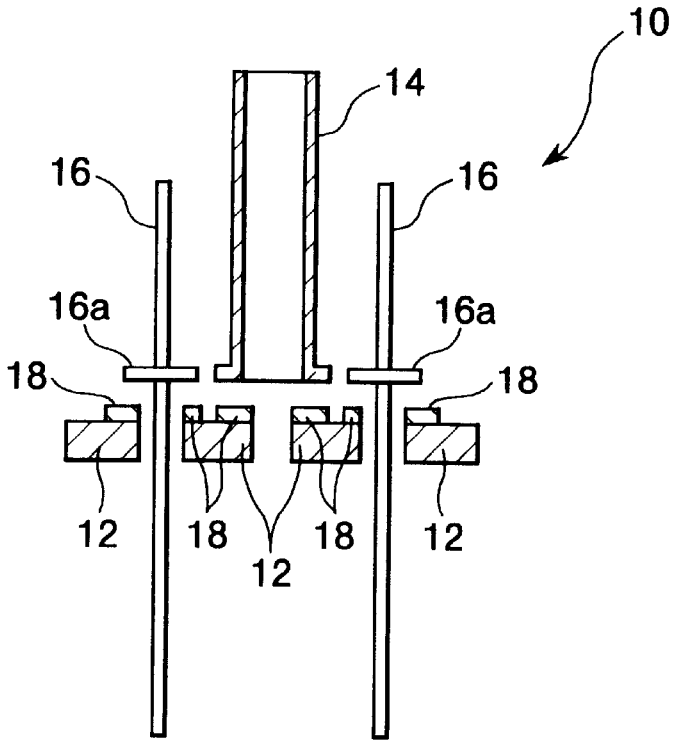

As shown in FIG. 1, the transmission type X-ray tube is constructed by first manufacturing the stem unit 10 using the hlgh-temperature brazing material 18 and then brazing the focusing electrode 24, ceramic bulb 26, and output window 28 to the stem unit 10 using the low-temperature brazing material 22. Hence, the X-ray tube assembly can be performed after the stem unit 10 assembly, thereby simplifying the assembly process.

The focusing electrode 24 in the X-ray tube contains a slanted portion 24*c* for separating the inner surface of the ceramic bulb 26 and the outer surface of the focusing electrode 24. Hence, the slanted portion 24*c* forms a gap between the ceramic bulb 26 and the focusing electrode 24. Further, a long distance can be reserved between the point at which the output window 28 and ceramic bulb 26 meet and the point at which the focusing electrode 24 and ceramic bulb 26 meet. As a result, voltage resistivity can be maintained.

The X-ray tube is also provided with a conductive target voltage application cap 30 for applying target voltage to the output window 28. The conductive target voltage application cap 30 can protect the output window 28 and prevent the window from cracking or incurring other damage. Also, the flange portion 30*b* of the conductive target voltage cap 30 can ensure that a reliable connection is made with the power source for applying a target voltage.

Figure 6:
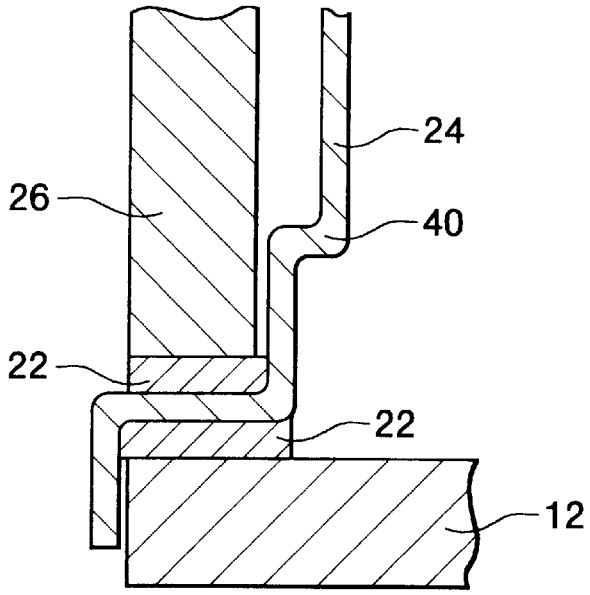
FIG. 6 is an explanatory diagram for a variation of the embodiment.

Although the present invention has been described with respect to a specific embodiment, it will be appreciated by one skilled in the art that a variety of changes and modifications may be made without departing from the scope of the invention. Although in the embodiment described above, the slanted portion 24*c* is provided on the focusing electrode 24 for separating the ceramic bulb and the focusing electrode, a stepped portion 40 could be provided on the focusing electrode 24 instead, as shown in FIG. 6. By this stepped portion 40, not only is a gap provided between the inner surface of the ceramic bulb 26 and outer surface of the focusing electrode 24, but vibrations in the focusing electrode 24 can be prevented.

Figure 7:
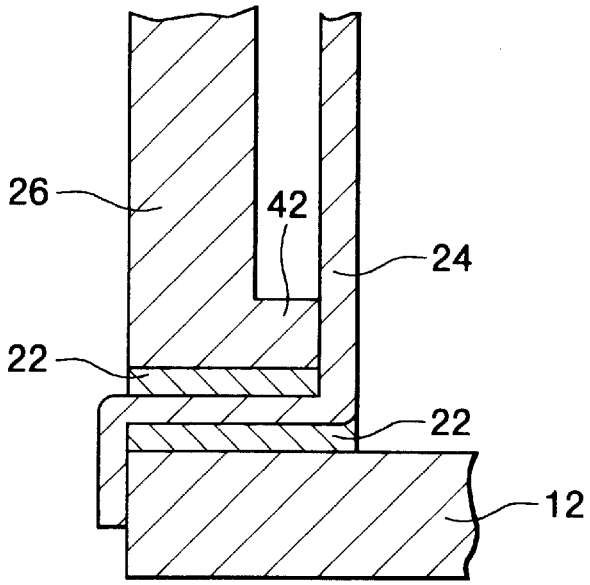
FIG. 7 is an explanatory diagram for a variation of the embodiment.

Further, a radially inwardly extending protruding portion 42 could be formed on the lower end portion of the ceramic bulb 26 for separating the ceramic bulb and the focusing electrode, as shown in FIG. 7. This protruding portion 42 can achieve the same effects as the stepped portion 40 described above.

Figure 8:
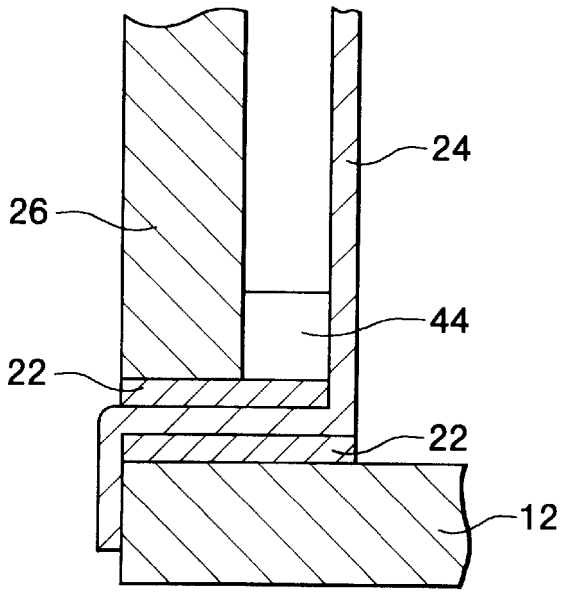
FIG. 8 is an explanatory diagram for a variation of the embodiment.
Figure 9:
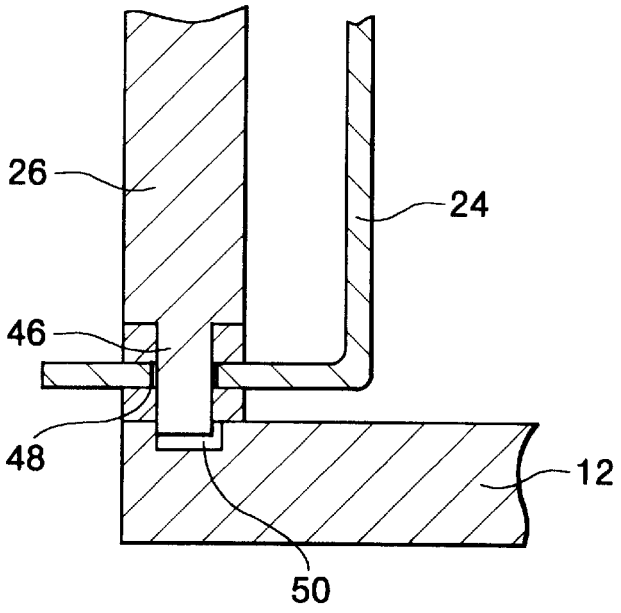
FIG. 9 is an explanatory diagram for a variation of the embodiment.

Further, a ring-shaped spacer 44 formed of ceramic or metal could be provided for separating the ceramic bulb and the focusing electrode, as shown in FIG. 8. With this ring-shaped spacer 44, the ceramic bulb and the focusing electrode can be separated without complicating the shape of either.

Further, a plurality of downwardly extending protrusions 46 could be formed on the lower end of the ceramic bulb 26 and a plurality of holes 48, through which the protrusions 46 are inserted, could be formed in the focusing electrode 24 for separating the ceramic bulb and the focusing electrode. Also, depressions 50 could be formed at corresponding positions in the bottom plate member 12, into which depressions the protrusions 46 are fitted.

Figure 10:
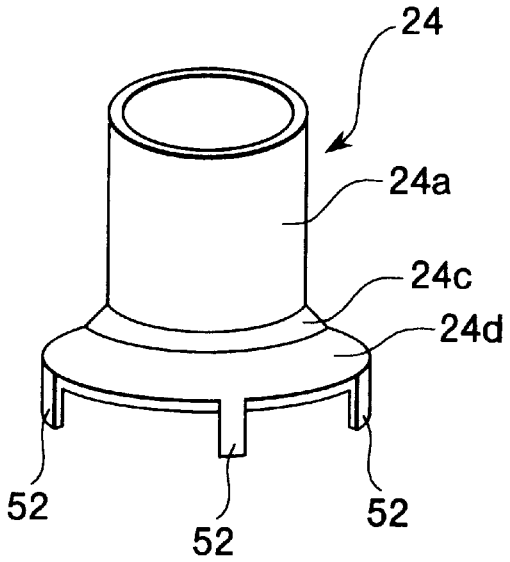
FIG. 10 is an explanatory diagram for a variation of the focusing electrode of the embodiment.

In the embodiment described above, the focusing electrode 24 is fixed to the stem unit 10 by intimately contacting the inner surface of the lower cylindrical portion 24*b* of the focusing electrode 24 to the outer surface of the bottom plate member 12 of the stem unit 10. However, it is also possible to fix these two components by providing pawls 52 on the focusing electrode 24, as shown in FIG. 10.

In the embodiment described above, the upper cylindrical portion 24*a* of the focusing electrode 24 is formed from Kovar metal as a cylindrical wall, but this cylindrical wall can also be formed as a mesh. This mesh formation can increase the effectiveness of exhausting the ceramic bulb 26.

Figure 11:
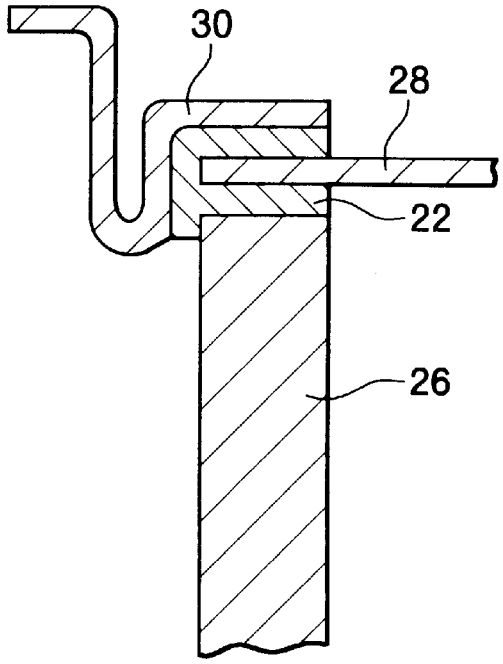
FIG. 11 is an explanatory diagram for a variation of the conductive target voltage application cap of the embodiment.
Figure 12:
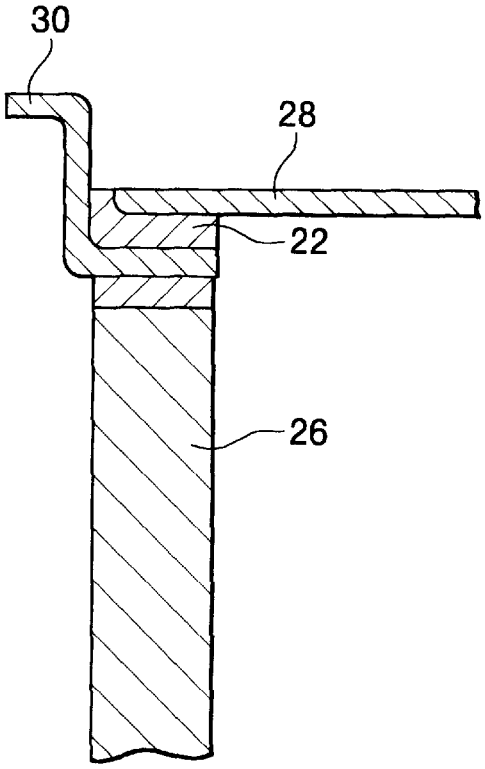
FIG. 12 is an explanatory diagram for a variation of the conductive target voltage application cap of the embodiment.
Figure 13:
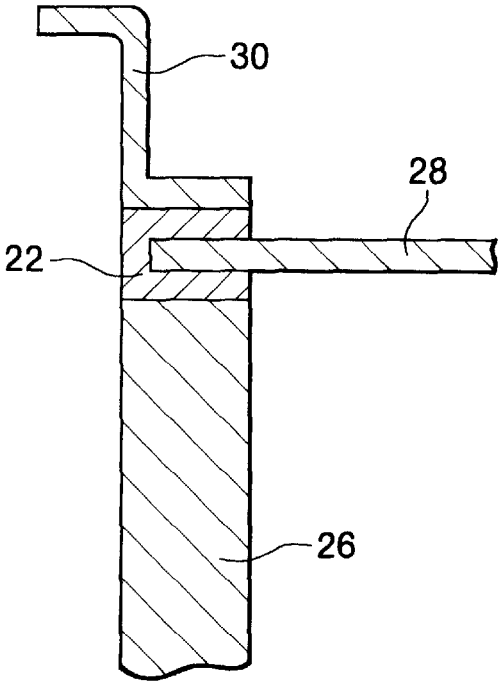
FIG. 13 is an explanatory diagram for a variation of the conductive target voltage application cap of the embodiment.
Figure 14:
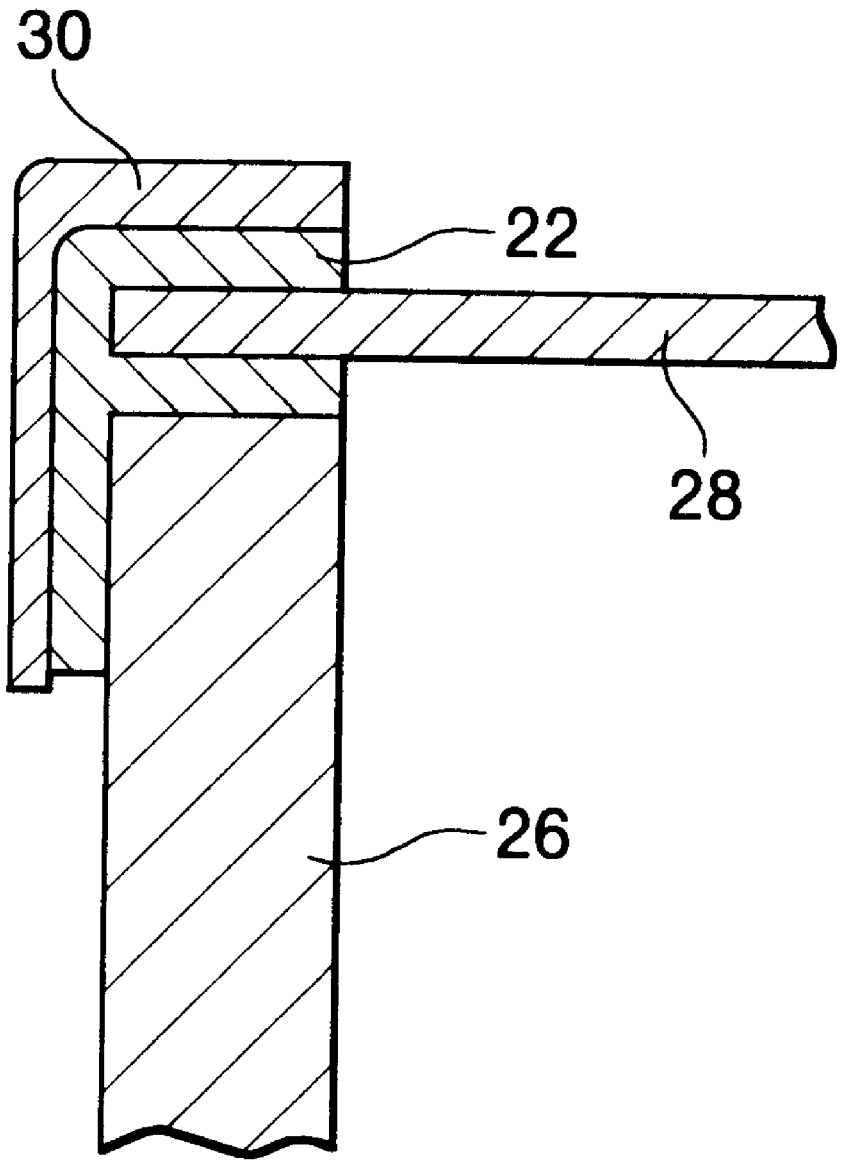
FIG. 14 is an explanatory diagram for a variation of the conductive target voltage application cap of the embodiment.

In the embodiment described above, a conductive target voltage application cap 30 shaped as shown in FIG. 5 is used. However, it is also possible to use a conductive target voltage application cap 30 shaped as shown in FIGS. 11, 12, and 14. The conductive target voltage application cap 30 shown in FIG. 13 is shaped the same as the conductive target voltage application cap 30 shown in FIG. 12, but the output window 28 is positioned below the conductive target voltage application cap 30 in FIG. 13.

In the embodiment described above, silver solder (Ag 99.9%) is used as the high-temperature brazing material 18 and a solder composed of silver (72%), copper (26%), and titanium (2%) is used as the low-temperature brazing material 22. However, the high-temperature brazing material 18 can be any brazing material having a brazing temperature higher than the low-temperature brazing material 22, while the low-temperature brazing material 22 can be any brazing material having a brazing temperature lower than the high-temperature brazing material 18. Hence, silver-copper solder (brazing temperature of 780–900° C.), brass solder (brazing temperature of 800–935° C.), copper solder (brazing temperature of 1,083° C.), nickel solder (brazing temperature of 975–1,070° C.), and gold solder (brazing temperature of 1,064° C.) can be used as the hlgh-temperature brazing material 18. For the low-temperature brazing material 22, brazing material composed of silver (Ag), copper (Cu), lead (Sn), and titanium (Ti) (brazing temperature of 620–750° C.), brazing material composed of silver (Ag), copper (Cu), indium (In), and titanium (Ti) (brazing temperature of 620–710° C.), and the like can be used, providing the brazing temperature of the chosen brazing material is lower than that of the chosen high-temperature brazing material 18.

In the method for manufacturing an X-ray tube of the present invention, an X-ray tube can be manufactured according to an X-ray tube assembly process and low-temperature brazing process after first manufacturing a stem unit according to a stem unit assembly process and high-temperature brazing process, thereby simplifying the X-ray manufacturing process.

What is claimed is:

1. A method for manufacturing an X-ray tube comprising the steps of:

a stem unit assembly process wherein a pair of cathode pins are inserted through a high-temperature brazing material into respective cathode pin holes formed on a bottom plate making up a stem unit;

a high-temperature brazing process wherein the stem unit assembled in the stem unit assembly process is heated to a brazing temperature of the high-temperature brazing material used in the stem unit;

an X-ray tube assembly process wherein a focusing electrode, a ceramic bulb, and an output window are placed over the stem unit with a low-temperature brazing material interposed between the bottom plate and the focusing electrode, between the focusing electrode and the ceramic bulb, and between the ceramic bulb and the output window to assemble the X-ray tube; and a low-temperature brazing process wherein the X-ray tube assembled in the X-ray tube assembly process is heated to a brazing temperature of the low-temperature brazing material used in the X-ray tube assembly, the brazing temperature of the low-temperature brazing material being lower than the brazing temperature of the high-temperature brazing material.

2. The method according to claim 1, wherein the high-temperature brazing material is a silver solder.

3. The method according to claim 1, wherein the low-temperature brazing material is composed of silver, copper, and titanium.

4. The method according to claim 1, wherein in the X-ray tube assembly process, a conductive target voltage application cap is further placed over the output window with the low-temperature brazing material interposed therebetween.

5. The method according to claim 1, wherein in the X-ray tube assembly process, a lower end of the ceramic bulb is placed over a slanted portion provided around a periphery of the focusing electrode so that the ceramic bulb can be slipped over the slanted portion and a gap can be created between an outer peripheral surface of the focusing electrode and an inner peripheral surface of the ceramic bulb.

* * * * *